US007974736B2

(12) United States Patent
Morin et al.

(10) Patent No.: US 7,974,736 B2
(45) Date of Patent: Jul. 5, 2011

(54) ROBOT DEPLOYED WEAPON SYSTEM AND SAFING METHOD

(75) Inventors: Gary R. Morin, Hardwick, MA (US); Daniel R. Deguire, Blackstone, MA (US); Kurt Bruck, Providence, RI (US); James Chung, Brookline, MA (US); David Platt, Port Saint John, FL (US)

(73) Assignee: Foster-Miller, Inc., Waltham, MA (US)

( * ) Notice: Subject to any disclaimer, the term of this patent is extended or adjusted under 35 U.S.C. 154(b) by 1037 days.

(21) Appl. No.: 11/732,875

(22) Filed: Apr. 5, 2007

(65) Prior Publication Data

US 2010/0263524 A1 Oct. 21, 2010

(51) Int. Cl.
*B25J 9/00* (2006.01)

(52) U.S. Cl. ..... 700/245; 900/6; 318/568.24; 89/1.11

(58) Field of Classification Search ..... 700/245, 700/253; 318/568.11, 568.12, 568.24; 901/6, 901/49, 50

See application file for complete search history.

(56) References Cited

U.S. PATENT DOCUMENTS

| | | | | |
|---|---|---|---|---|
| 4,621,562 | A | 11/1986 | Carr et al. | |
| 4,932,831 | A | 6/1990 | White et al. | |
| 5,022,812 | A | 6/1991 | Coughlan et al. | |
| 6,113,343 | A | 9/2000 | Goldenberg et al. | |
| 6,269,730 | B1 | 8/2001 | Hawkes et al. | |
| 6,535,793 | B2 | 3/2003 | Allard | |
| 6,578,464 | B2 | 6/2003 | Ebersole, Jr. et al. | |
| 6,745,663 | B2 | 6/2004 | Ebersole, Jr. et al. | |
| 6,860,206 | B1 | 3/2005 | Rudakevych et al. | |
| 6,889,594 | B2 | 5/2005 | Ebersole, Jr. et al. | |
| 7,143,696 | B2 | 12/2006 | Rudakevych et al. | |
| 7,346,429 | B2 * | 3/2008 | Goldenberg et al. | 700/245 |
| 7,548,697 | B2 * | 6/2009 | Hudson et al. | 398/106 |
| 7,559,269 | B2 * | 7/2009 | Rudakevych et al. | 89/27.11 |
| 2001/0045883 | A1 * | 11/2001 | Holdaway et al. | 340/5.51 |
| 2004/0216932 | A1 | 11/2004 | Giovanetti et al. | |
| 2005/0004708 | A1 * | 1/2005 | Goldenberg et al. | 700/245 |
| 2006/0037508 | A1 | 2/2006 | Rudakevych et al. | |
| 2007/0029117 | A1 * | 2/2007 | Goldenberg et al. | 180/9.32 |
| 2007/0105070 | A1 * | 5/2007 | Trawick | 434/11 |
| 2007/0119326 | A1 * | 5/2007 | Rudakevych et al. | 102/206 |
| 2007/0193790 | A1 * | 8/2007 | Goldenberg et al. | 180/9.1 |

(Continued)

OTHER PUBLICATIONS

U.S. Appl. No. 11/543,427, filed Oct. 10, 2006, Deguire et al.

(Continued)

*Primary Examiner* — Benjamin P Lee
(74) *Attorney, Agent, or Firm* — Iandiorio Teska & Coleman

(57) ABSTRACT

This subject invention features a robot deployed weapon system. A remotely controlled mobile robot has a weapon mounted to the robot. There is a firing circuit for the weapon and a weapon interrupt module on board the robot. An operator control unit is for remotely operating the robot and the weapon. The operating control unit preferably includes a stop switch. Also, a separate operator module is in communication with the weapon interrupt module. Preferably, the operator module includes a kill switch. There are two communication links. The first communication link is between the operator control unit and the robot. This communication link is configured to safe the weapon if the stop switch is activated and/or the first communication link degrades. The second communication link is between the operator module and the weapon interrupt module. The communication link is configured to safe the weapon if the kill switch is activated and/or the second communication link degrades.

12 Claims, 10 Drawing Sheets

U.S. PATENT DOCUMENTS

| | | | | |
|---|---|---|---|---|
| 2007/0204745 | A1* | 9/2007 | Son et al. | 89/27.3 |
| 2007/0209501 | A1* | 9/2007 | Ko | 89/40.01 |
| 2008/0063400 | A1* | 3/2008 | Hudson et al. | 398/106 |
| 2008/0083344 | A1* | 4/2008 | Deguire et al. | 102/262 |
| 2008/0105481 | A1* | 5/2008 | Hutcheson et al. | 180/209 |
| 2008/0121097 | A1* | 5/2008 | Rudakevych et al. | 89/28.05 |
| 2008/0131237 | A1* | 6/2008 | van der Meulen | 414/217 |
| 2008/0150467 | A1* | 6/2008 | Hashimoto et al. | 318/568.17 |
| 2008/0266254 | A1* | 10/2008 | Robbins et al. | 345/161 |
| 2008/0312937 | A1* | 12/2008 | Huang | 705/1 |
| 2009/0129003 | A1* | 5/2009 | Bruck et al. | 361/679.4 |
| 2009/0164045 | A1* | 6/2009 | Deguire et al. | 700/259 |
| 2009/0212731 | A1* | 8/2009 | Endresen et al. | 318/568.24 |

OTHER PUBLICATIONS

Northrop Grumman Remotec ANDROS F6A Heavy Duty Robot, http://www.es.northropgrumman.com/remotec/f6a.htm (1pg).

Northrop Grumman Electronic Systems-Accessories for Remotec ANDROS F6A, http://www.es.northropgrumman.com/remotec/details/f6a_accessories.htm (2pgs).

Northrop Grumman Remotec ANDROS F6A Heavy Duty Robot, http://www.es.northropgrumman.com/remotec/details/f6a_specs.htm (2pgs).

Northrop Grumman Remotec ANDROS F6A Heavy Duty Robot, http://www.es.northropgrumman.com/remotec/wolverine.htm (1pg).

Northrop Grumman Electronic Systems-Remotec ANDROS Wolverine Accessories, http://www.es.northropgrumman.com/remotec/details/wolverine_accessories.htm (2pgs).

Northrop Grumman Remotec ANDROS Mark V-A1 Hazardous Duty Robot, http://www.es.northropgrumman.com/remotec/markval.htm (2pgs).

Northrop Grumman Electronic Systems-Remotec-Law Enforcement, SWAT Application, http://www.es.northropgrumman.com/remotec/law_enforcement_swat.htm (2pgs).

Battelle, Law Enforcement Robot Technology Assessment, TWSWG Task T-150B2, Apr. 2000 (87pgs).

Northrop Grumman Remotec ANDROS F6A Heavy Duty Robot, http://www.es.northropgrumman.com/remotec/f6a.htm (2 pgs).

Northrop Grumman Remotec ANDROS F6A Heavy Duty Robot, http://www.es.northropgrumman.com/remotec/details/f6a_specs.htm (3 pgs).

* cited by examiner

ROBOT DEPLOYED WEAPON SYSTEM AND SAFING METHOD

FIELD OF THE INVENTION

This subject invention relates to robotics, weapon control, and remotely controlled mobile robots equipped with weapons.

BACKGROUND OF THE INVENTION

The notion of a mobile remotely controlled robot with a weapon mounted thereto is intriguing. The robot could be maneuvered into a hostile situation and the weapon fired by an operator positioned out of harm's way.

To date, such a system has not been deployed by the military primarily because of safety concerns. That is, steps must be taken to ensure that the weapon fires only when the operator so intends, stops firing when desired, and does not fire in the case of a malfunction with the robot, the weapon, and/or any of the controlling electronics or software.

SUMMARY OF THE INVENTION

It is therefore an object of this invention to provide a mobile remotely controlled weapon platform which is safe.

It is a further object of this invention to provide a robot deployed weapon system wherein the weapon can be fired only when the operator so intends.

It is a further object of this invention to provide such a robot deployed weapon system wherein the weapon stops firing quickly when desired.

It is a further object of this invention to provide such a robot deployed weapon system wherein the weapon is prohibited from firing in a case of a malfunction of the robot and/or a malfunction of the weapon.

It is a further object of this invention to provide such a robot deployed weapon system wherein the weapon is prohibited from firing when the robot is out of range.

It is a further object of this invention to provide a system and method for safely controlling weapons on platforms other than robots and devices other than weapons on robotic or other platforms.

The subject invention results from the realization that a safe remotely controlled mobile robot equipped with a weapon is effected by two separate communication links between the robot and the operator, each communication link configured to safe the weapon when any one of a number of conditions occur.

The subject invention, however, in other embodiments, need not achieve all these objectives and the claims hereof should not be limited to structures or methods capable of achieving these objectives.

This subject invention features a deployed weapon system comprising a remotely controlled mobile robot or other platform with a weapon mounted to the robot. There is a firing circuit for the weapon and a weapon interrupt module on board the robot. An operator control unit is for remotely operating the robot and the weapon. The operating control unit preferably includes a stop switch. Also, an operator module is in communication with the weapon interrupt module. Preferably, the operator module includes a kill switch. There are thus two independent communication links. The first communication link is between the operator control unit and the robot. This communication link is configured to safe the weapon if the stop switch is activated and/or the first communication link degrades. The second communication link is between the operator module and the weapon interrupt module. This communication link is configured to safe the weapon if the kill switch is activated and/or the second communication link degrades.

In one example, the weapon includes a safety and the robot further includes a safety actuator. Then, the first communication link is configured to activate the safety actuator to engage the safety of the weapon if the stop switch is activated and/or the first communication link degrades. Preferably, the second communication link is also configured to activate the safety actuator to engage the safety of the weapon if the kill switch is activated and/or the second communication link degrades.

In one example, the operator control unit includes an Arm 1 switch, an Arm 2 switch, and a trigger switch which must be activated in order before the firing circuit can fire the weapon.

Typically, the range of the second communication link is longer than the range of the first communication link.

In the preferred embodiment, the first communication link includes a transceiver on the robot, a controller on the robot, a transceiver in the operator control unit, and a controller in the operator control unit. The controller of the operator control unit is configured to send a periodic message via the transceiver of the operator control unit to the transceiver on the robot and the controller of the robot is configured to safe the weapon if the periodic message is not received. Also, the second communication link includes a transceiver in the weapon interrupt module, a controller in the weapon interrupt module, a transceiver in the operator module, and a controller in the operator module. The controller of the operator unit is configured to send a periodic message via the transceiver of the operator unit to the transceiver of the weapon interrupt module and the controller of the weapon interrupt module is configured to safe the weapon if the periodic message is not received.

Typically, the weapon is safed if either communication link degrades. If the operating control unit includes a stop switch and if the operator module includes a kill switch, the weapon is safed if either the stop switch and/or the kill switch are activated.

The subject invention also features a method of safely controlling a weapon. The method comprises equipping a robot or other platform with a weapon interrupt module, supplying the operator with an operator control unit which remotely controls the robot and the weapon. The operator control unit includes a stop switch. The operator is also supplied with an operator module in communication with the weapon interrupt module. The operator unit includes a kill switch. A first communication link is established between the operator control unit and the robot and the weapon is safed if the stop switch is activated and/or the first communication link degrades. A second communication link is established between the operator module and the weapon interrupt module and the weapon is safed if the kill switch is activated and/or the second communication link degrades.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
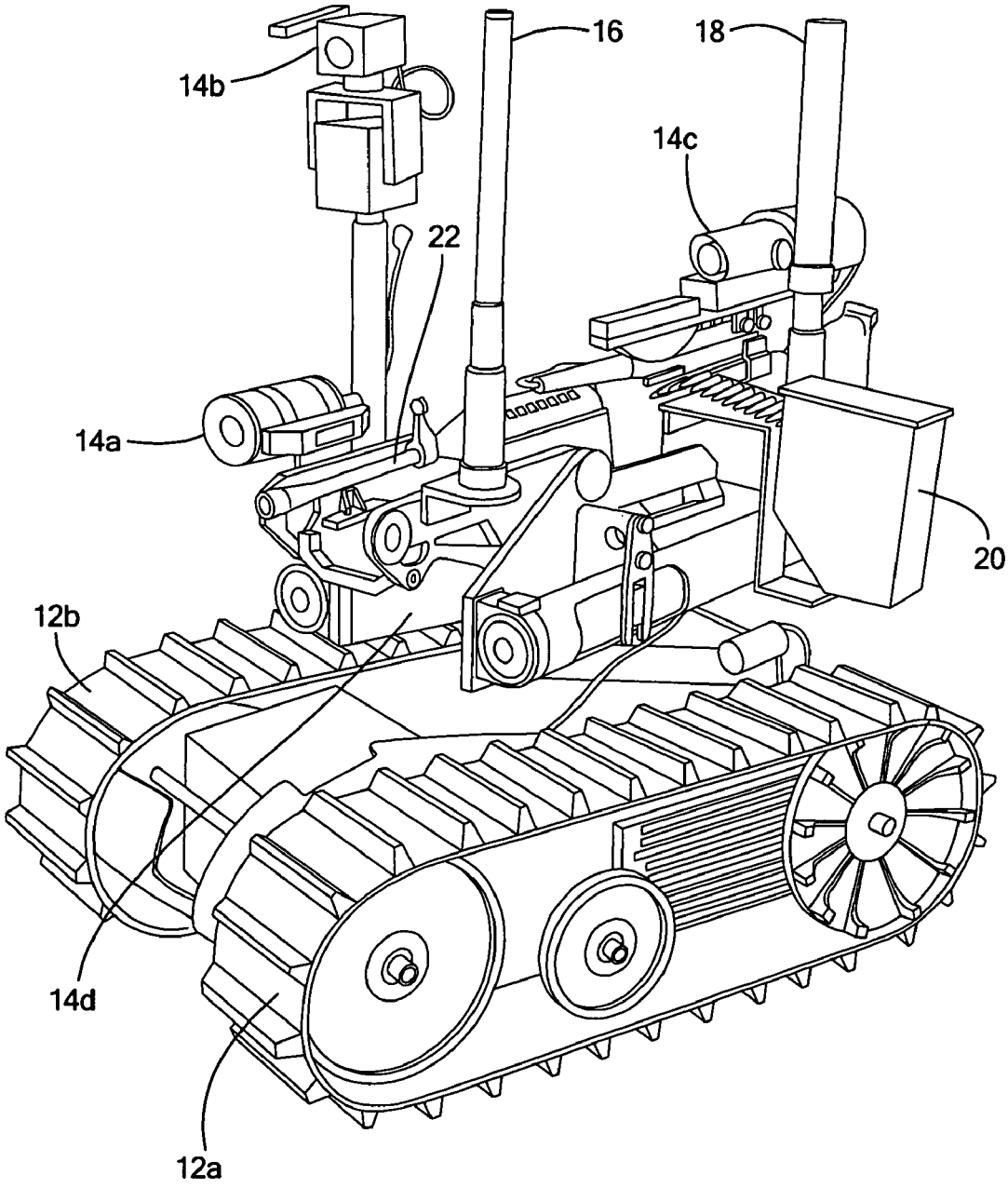
FIG. 1 is a schematic three-dimensional view of an example of a remotely controlled mobile robot weapon platform in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of a robot 10 in accordance with this invention. The basic robot platform is preferably based on Foster-Miller, Inc.'s (Waltham, Mass.) "Talon" robot and includes motor driven tracks 12*a* and 12*b*. Robot 10 also includes cameras 14*a*, 14*b*, 14*c*, and 14*d*; video antenna 18, data antenna 16, ammunition can mount 20 for weapon 22 (e.g., an M249 Squad Automatic Weapon) mounted to robot 10 via a telepresent rapid aiming platform (Precision Remotes, Inc., Point Richmond, Calif.). See, for example, U.S. Pat. No. 6,269,730 incorporated herein by this reference. Other robot platforms are possible in accordance with this invention. See, e.g., U.S. patent and application No. 2004/0216932; U.S. Pat. Nos. 5,022,812; and 4,932,831 incorporated herein by this reference. See also the Northrop Grumman Andros F6A robot.

Figure 2:
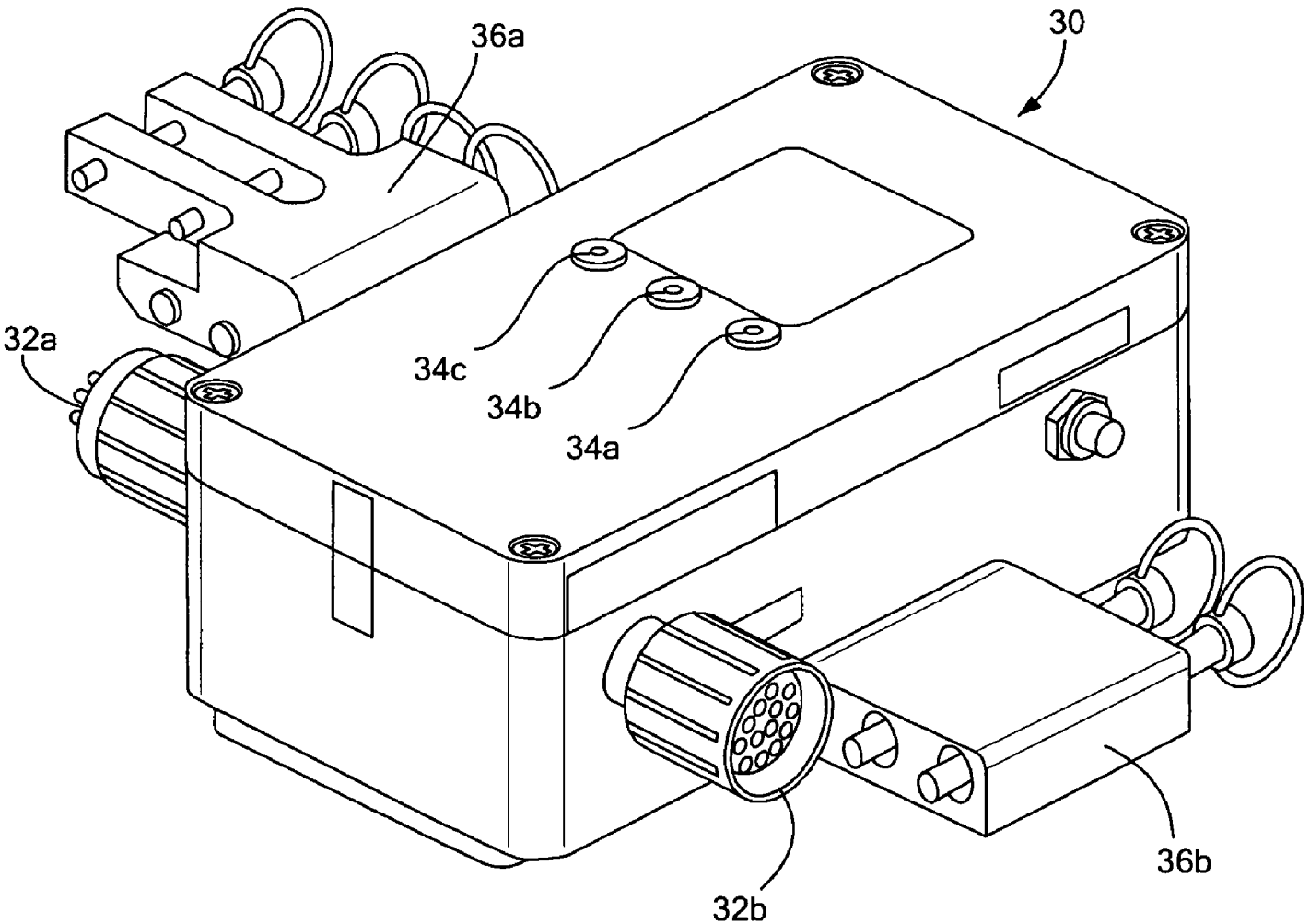
FIG. 2 is a schematic view showing an example of a power interrupt module mounted to the robot shown in FIG. 1.

Also on robot 10 is weapon interrupt module 30, FIG. 2. Module 30 includes port 32*a* which connects to the power supply (e.g., the batteries) of the robot and port 32*b* which connects to the robot's powered circuitry. Module 30 is configured to decouple the robot power supply when desired as explained herein. Module 30 includes LED indicators 34*a* (radios linked), 34*b* (radio power), and 34*c* (battery power). Also included are mounting brackets 36*a* and 36*b*.

Figure 3:
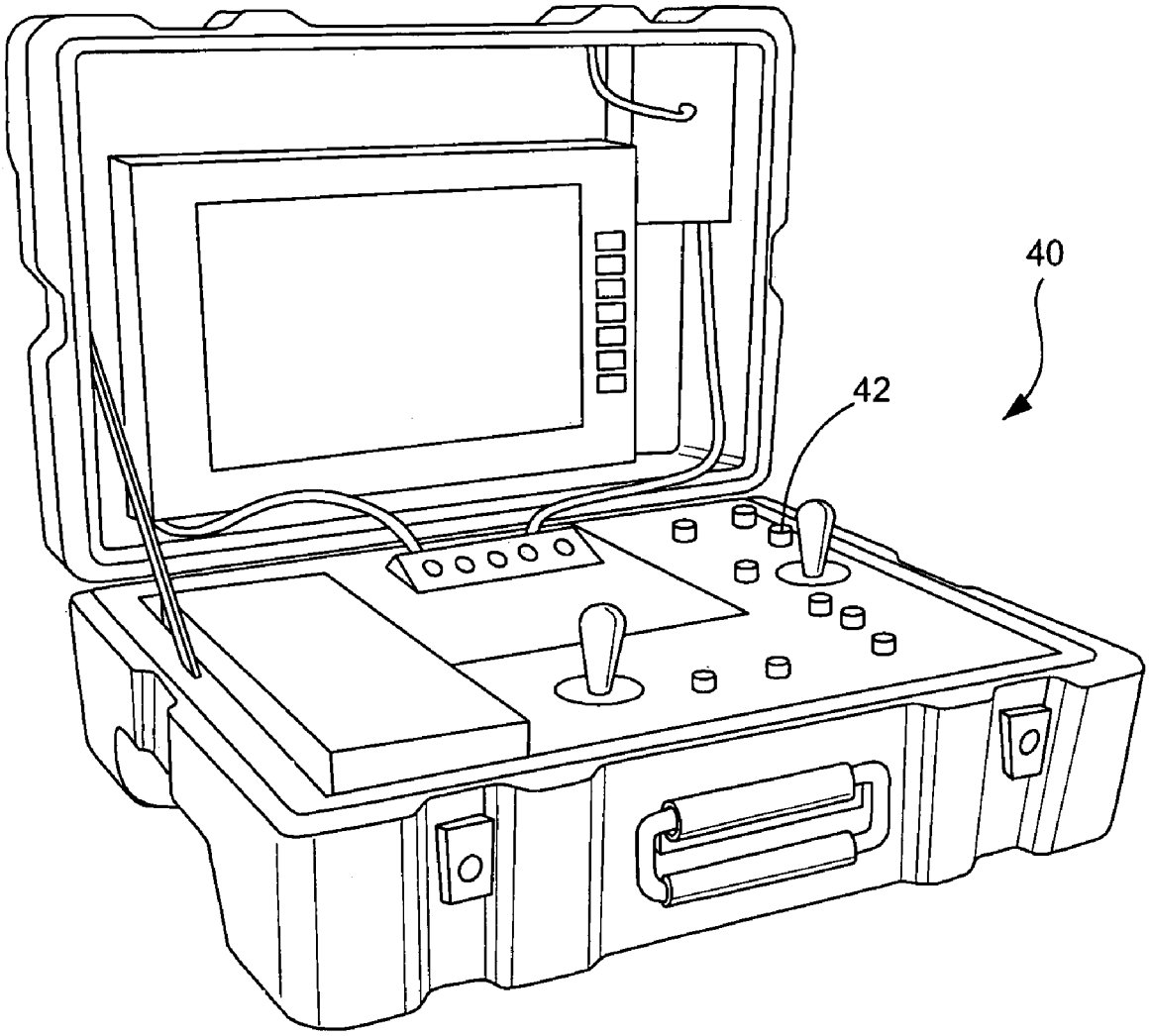
FIG. 3 is a schematic three-dimensional view showing an example of an operator control unit used to maneuver the robot shown in FIG. 1 and also to fire the weapon mounted to the robot.
Figure 4:
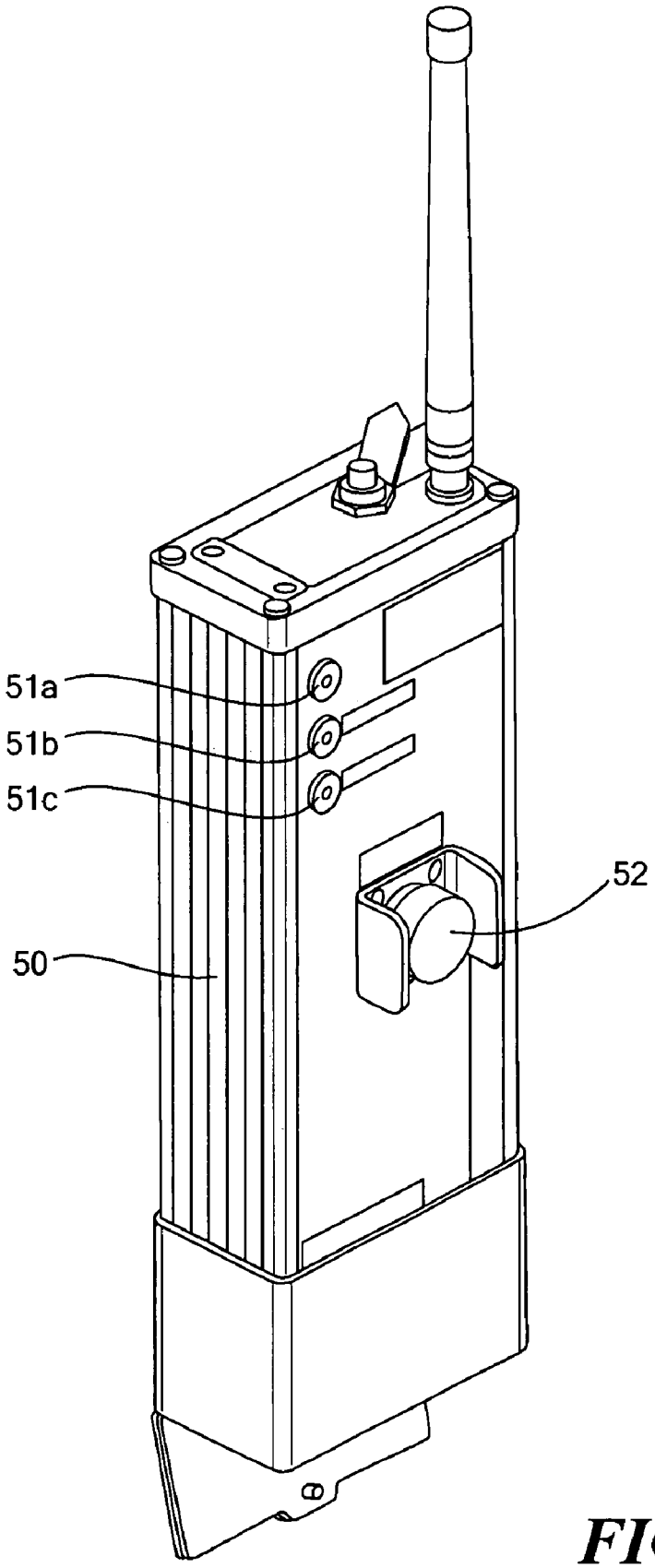
FIG. 4 is a schematic three-dimensional front view showing an example of a user power interrupt module in accordance with the subject invention.

Operator control unit 40, FIG. 3 is used to remotely control the robot and to fire the weapon mounted to the robot. Operator control unit 40 includes stop switch 42 which, when activated, safes the weapon. The operator is also provided with operator module 50, FIG. 4 which includes kill switch 52. When kill switch 52 is activated, the weapon is also rendered safe.

Figure 5:
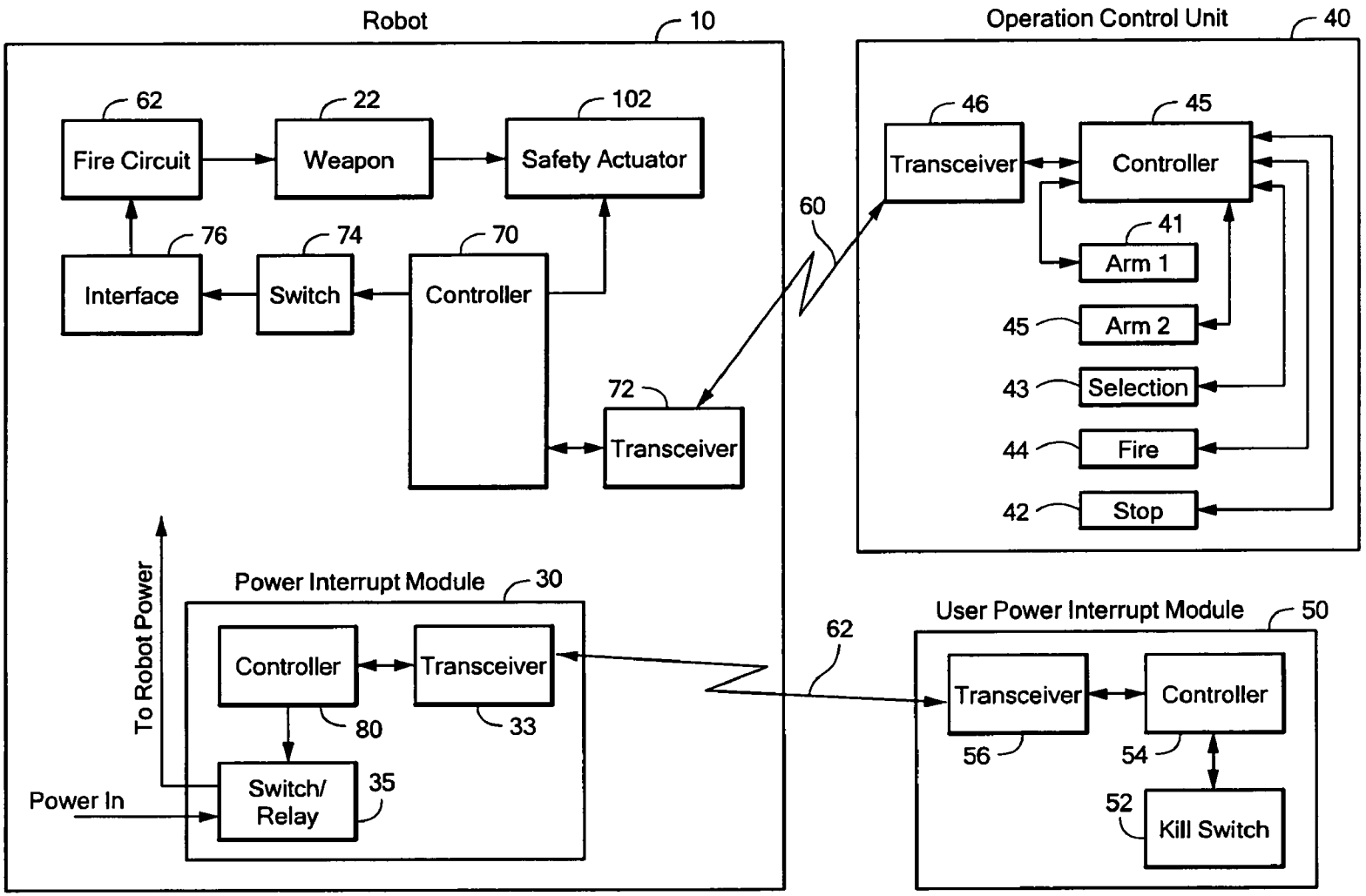
FIG. 5 is a block diagram showing the primary components associated with a robot deployed weapon system in one example in accordance with the subject invention.

One feature of the subject invention is the inclusion of two separate communication links between the operator and the robot. As shown in FIG. 5, there is a communication link 60 between operator control unit 40 and robot 10 and also a communication link 62 between user power interrupt module 50 and power interrupt module 30 onboard robot 10.

Preferably, weapon 22 is automatically rendered safe and incapable of firing a) if robot 10 is out of range of operator control unit 40 and communication link 60 degrades, b) if robot 10 is out of range of user power interrupt module 50 and communication link 62 degrades, c) if stop switch 42 of operator control unit 40 is activated, or d) if kill switch 52 of user power interrupt module 50 is actuated. Communication link degradation can be the total absence of a signal and/or incomplete or interrupted signals.

In this way, redundant safety measures are provided and weapon 22 cannot be fired unless the operator so intends. Also, the weapon stops firing or is rendered incapable of firing when the operator intends or in the case of a malfunction. If either communication link 60 or 62 fails or malfunctions, the weapon can still be rendered safe by the other communication link. There are many ways to safe weapon 22 and thus the following description relates only to one preferred embodiment.

Figure 6:
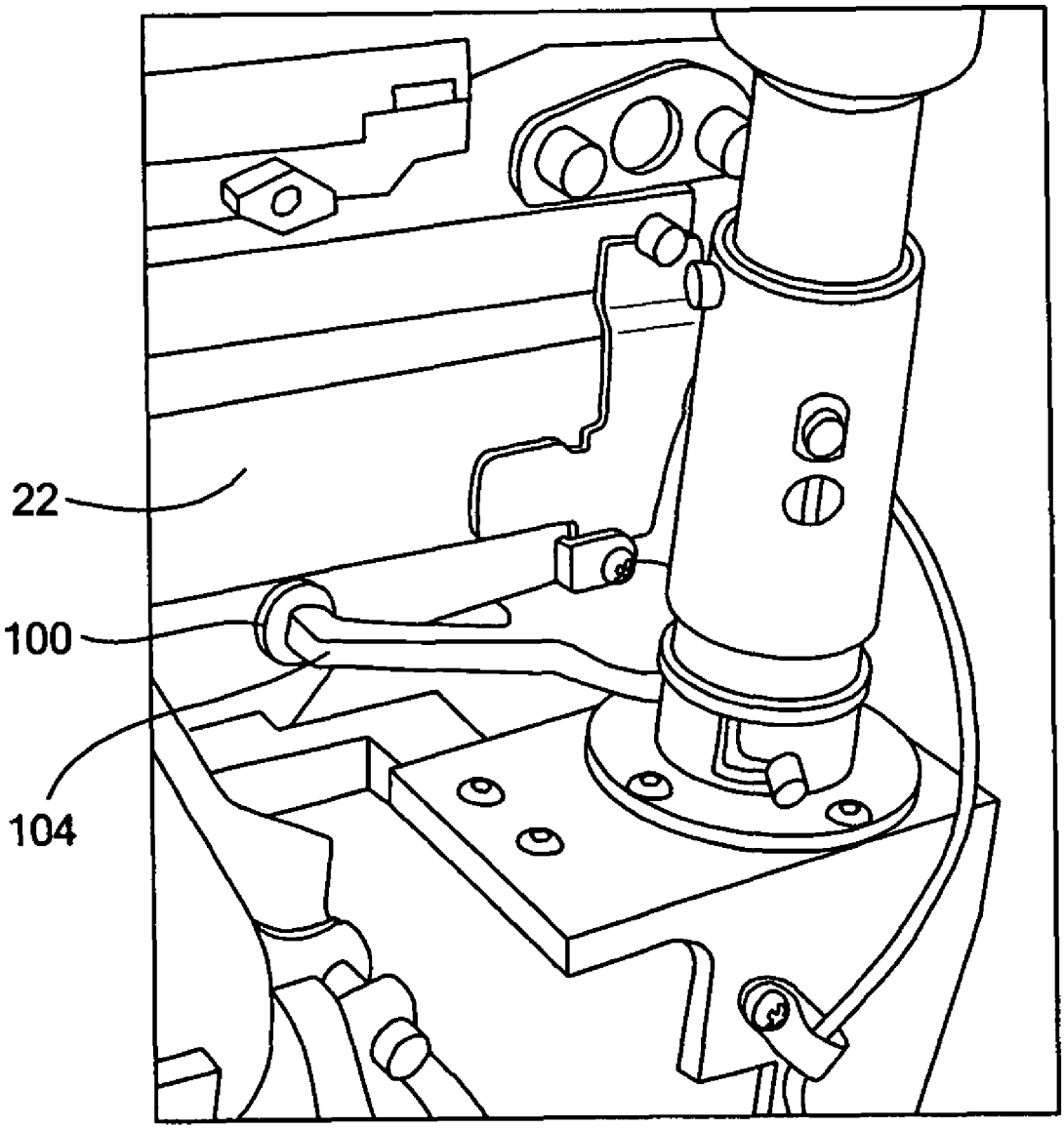
FIG. 6 is a schematic three-dimensional view showing an example of a safety actuator in accordance with the subject invention.

In one specific design, weapon 22, FIG. 6 includes safety button 100 and the robot includes weapon mount 102 for the weapon. Subassembly 102 includes safety actuator fork 104, FIGS. 6-7 driven to engage and release safety button 100, FIG. 6 under the control of controller 70, FIG. 5. Controller 70 is programmed or configured to automatically actuate safety actuator fork 104, FIGS. 6-7 to turn the safety on and safe the weapon if stop switch 42, FIG. 5 is activated and/or communication link 60 between robot 10 and operator control unit 40 degrades.

Figure 7:
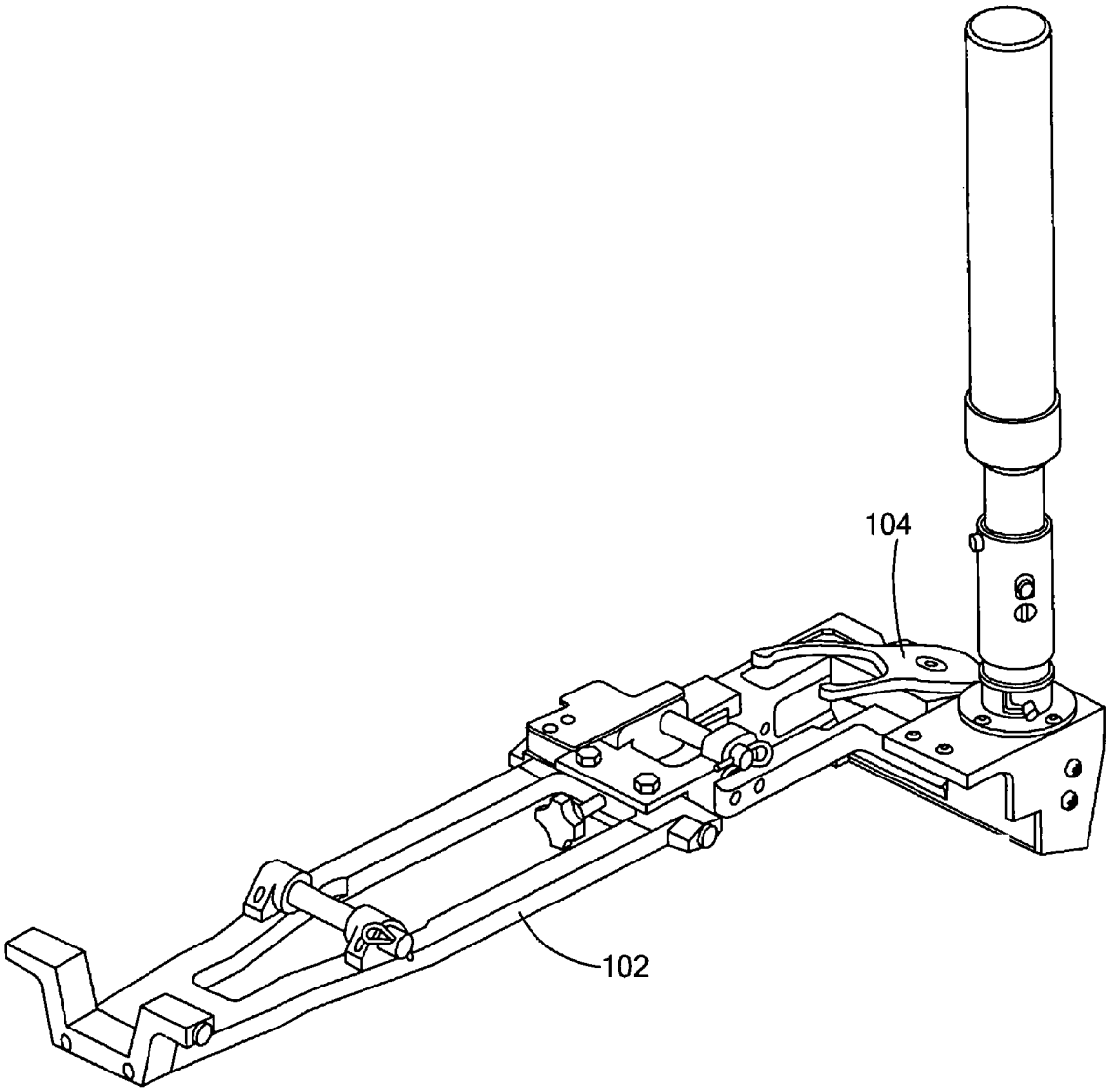
FIG. 7 is a three-dimensional schematic view showing the safety actuator of FIG. 6 with the weapon removed.

Also, controller 80, FIG. 5 of power interrupt module 30 may be programmed to automatically activate safety actuator fork 104, FIGS. 6-7 to turn the safety on and safe the weapon if kill switch 52, FIG. 5 of user power interrupt module 50 is activated and/or the communication link 62 between power interrupt module 30 on board the robot and user power interrupt module 50 degrades. Typically, though, if kill switch 52 is activated, or if communication link 62 degrades, only vehicle power is deactivated and actuator 104, FIG. 6 remains in the position it was prior to power cut-off. In another embodiment, if kill switch 52, FIG. 5 is actuated and/or communication link 62 degrades, controller 80 could provide output signals which applies the parking brake to a vehicle and/or cuts off its fuel supply.

In addition, before the safety of the weapon is switched to the off position and before firing circuit 62, FIG. 5 is capable of firing weapon 22, arm 1 switch 41, arm 2 switch 45, and fire switch 44 of operator control unit 40 must be activated in the proper sequence. See co-pending U.S. patent application Ser. No. 11/543,427 incorporated herein by this reference. See also U.S. Pat. No. 6,860,206 and U.S. Patent Application No. 2006/0037508 both incorporated herein by this reference.

Moreover, it is preferred that the range of communication link 62 between power interrupt module 30 on board the robot and user power interrupt module 50 via transceiver 56 of user power interrupt module 50 and transceiver 33 of power interrupt module 30 be greater than the communication link 60 between operator control unit 40 and robot 10 via transceiver 46 of operator control unit 40 and transceiver 72 on board robot 10. This ensures that in the event of a malfunction of robot 10 or a malfunction of fire circuit 62 or any of the controlling software or electronics, kill switch 52 of user power interrupt module 50 can be activated to stop any motion of the robot. Controller 54 receives a signal that kill switch 52 has been activated and sends a message to power interrupt module 30 via transceiver 56. Transceiver 33 of power interrupt module 30 receives this message and relays it to controller 80 which then activates switch or relay 35 to break the power connection from the robot's power supply to the circuitry of the robot as shown by the power in and power out connections in FIG. 2. The robot is thus not powered and its circuitry will stop operating so the robot ceases any maneuvers and in addition weapon 22, FIG. 5 in incapable of firing. Fire circuit 62 is thus not powered and in addition no power is supplied to the robot's other subsystems.

Finally, controller 45 of operator control unit 40 is programmed to periodically send a message via transceiver 46 to robot 10. When transceiver 72 of robot 10, as detected by controller 70, does not receive this message, it activates safety actuator 102 to safe the weapon and also activates trigger switch 74 between controller 70 and interface electronics 76 for fire circuit 62 to stop the supply of any power to fire circuit 62.

In a similar fashion, controller 54 of user power interrupt module 50 is programmed to periodically send a message via transceiver 56 to power interrupt module 30. If transceiver 33 thereof does not receive this message, controller 80 trips switch/relay 35 and no power is supplied to fire circuit 62.

Controllers 70, 80, 54, and 45 may be microcontrollers, microprocessors, application specific integrated circuitry, equivalent controlling circuitry, or even analog circuitry configured as discussed above. Also, transceivers 33, 56, 46, and 72 may be separate receivers and transmitters coupled to their respective controllers as is known in the art.

Figure 8:
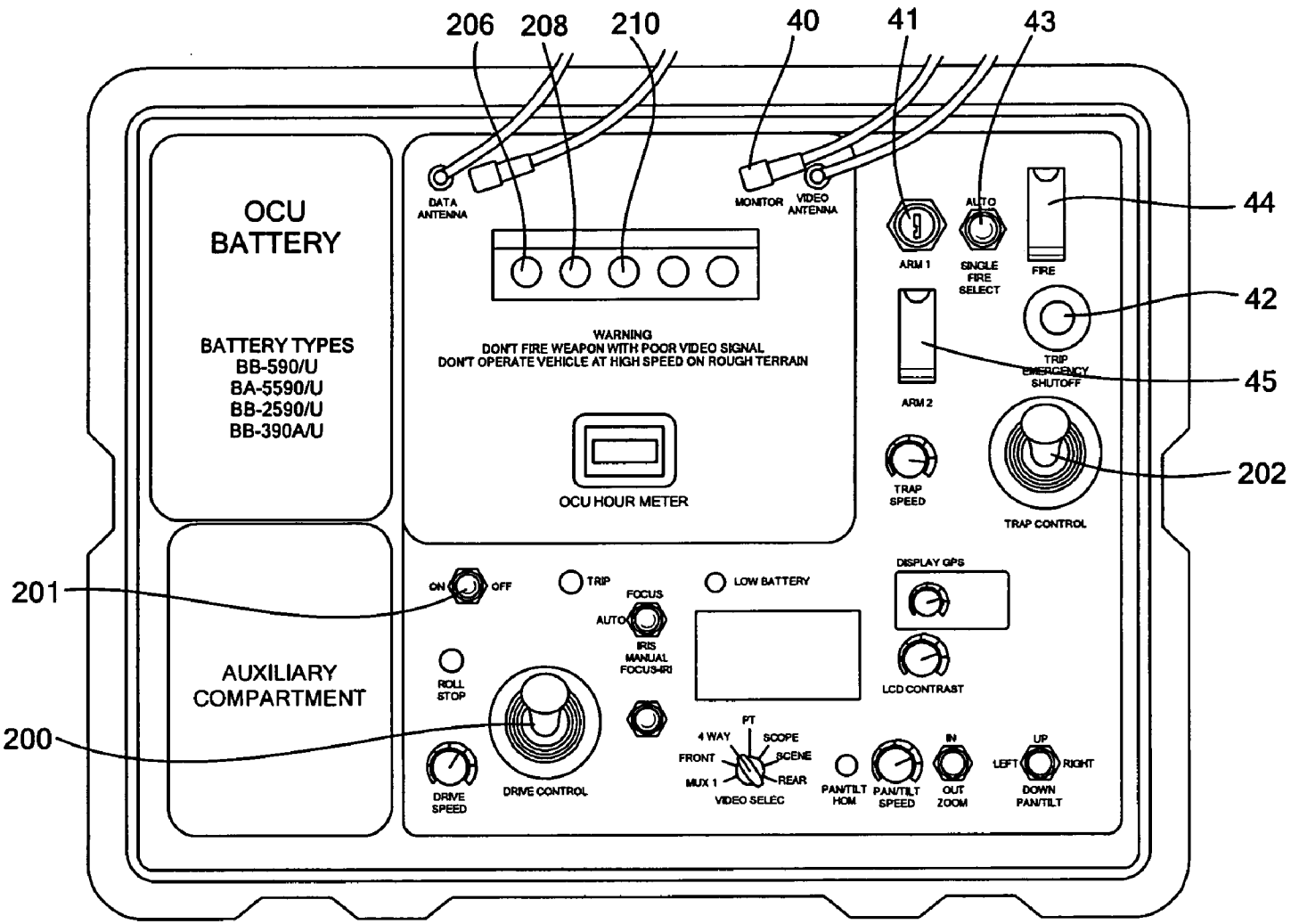
FIG. 8 is a schematic front view showing the various switches of the operator control unit shown in FIG. 3.

In one particular example, operator control unit 40, FIG. 8 includes switch and joy sticks grouped into three main areas. The upper right area as shown in FIG. 8 includes the arming and firing functions. The lower left area controls the speed and direction of the robot. The lower center area has camera switches. Vehicle status LCDs depict the orientation, direction, battery power remaining, and the like. Joy stick 200, FIG. 8 controls the speed and direction of the robot platform. Joy stick 202 controls the rate and direction of pan and tilt of the integrated telepresent rapid aiming platform of the weapon.

Figure 9:
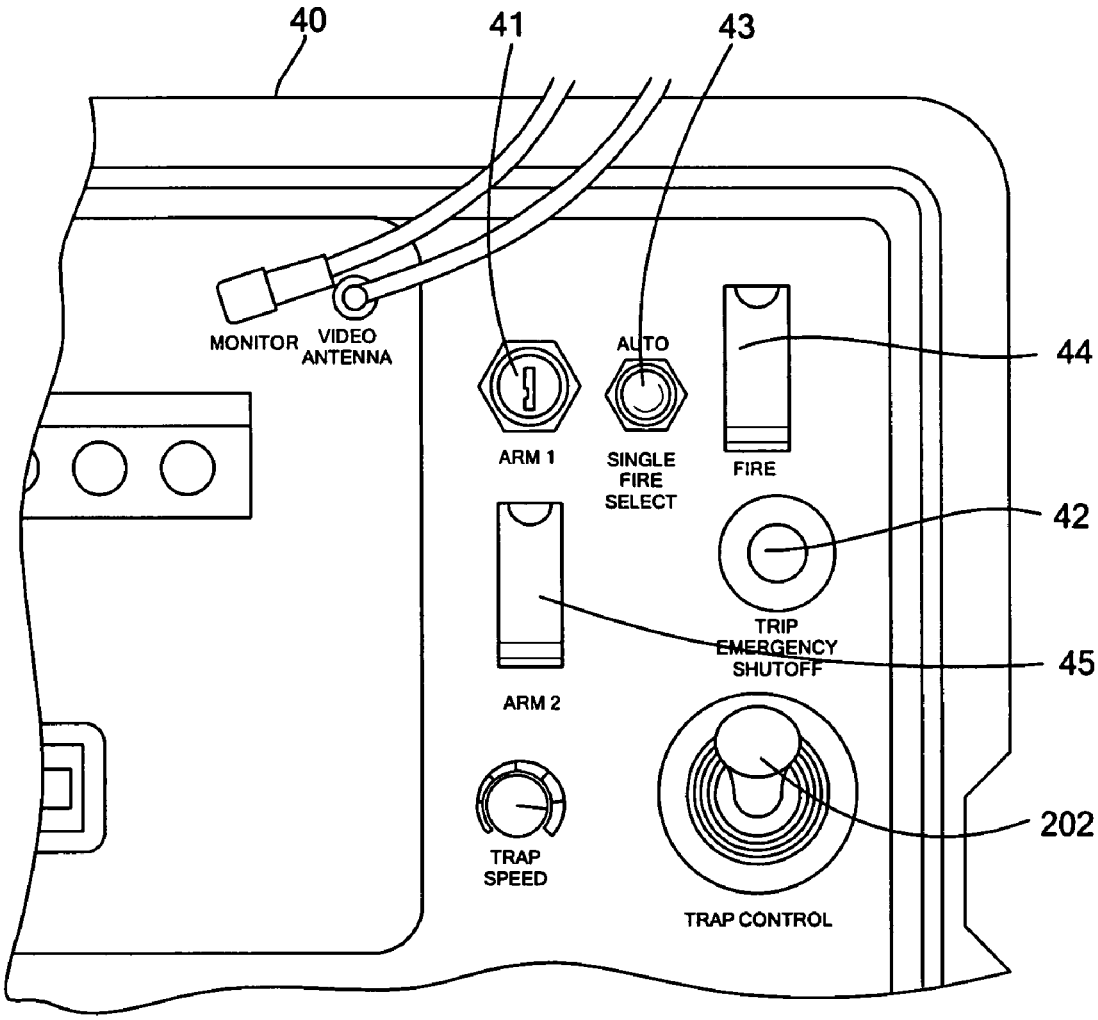
FIG. 9 is a schematic front view showing in more detail the switches shown in FIG. 8.

In order to fire the weapon, the operator must obtain a key, insert it in arm switch 41, FIG. 9 and select the auto or single mode firing via switch 43. The arm 1 switch is then rotated a quarter turn to the right. In response, controller 45, FIG. 5 sends a message via transceiver 46 to transceiver 72 on board the robot. Controller 70 receives this message and activates safety actuator 102 to switch the safety of the weapon off. Fire circuit 62 is also enabled now via controller 70. Controller 70 then sends a message via transceiver 72 to transceiver 46 of operator control unit 40 and controller 45 thereof activates arm 1 LED 206, FIG. 8. Fire circuit 62 communicates with controller 70 through interface 76. When the arm 1 command reaches fire circuit 62, it sends an acknowledgement through interface 76 to controller 70 which sends a signal via link 60 to OCU 40.

The safety cover of arm switch 45, FIG. 9 is then lifted and the toggle switch toggled until the arm 2 indicator 208, FIG. 8 is lit. Controller 45, FIG. 5 of operator control unit 40, upon receiving an indication that arm 2 switch 45 has been activated, sends a message via transceiver 46 to transceiver 72 of on board robot 10. Controller 70 receives this message and provides power to fire circuit 62 via switch 72 and interface 76. Controller 70 then provides feedback to operator control unit 40 in order to illuminate arm 2 LED 208, FIG. 8.

Weapon arm light 210 is also illuminated whenever the safety of the weapon is switched off. The cover of fire control switch 44, FIG. 9 is then lifted and the switch driven up to momentarily fire the weapon. In the automatic mode as selected by switch 43, firing will occur for 2.2 seconds. Fire toggle switch 44 can be recycled to continue automatic fire. In the single fire selected mode, only a single shot will be fired. All of these steps must be taken in the proper sequence. If they are not, controllers 70 and 45 are programmed to provide an error signal and firing circuit 62 is not activated.

The robot platform is preferably remotely maneuverable on most terrain such as mud, sand, rubble-type obstacles, 6-inch-deep water, and in most weather conditions. It is able to convey reliable imagery for reconnaissance and for engaging threat personnel and threat material targets both day and night. The robot is controllable in a wireless RF mode providing the operator with full control of all system functions at a distance of up to 800 meters line of sight without any performance degradation. The RF communication mode preferably utilizes frequency hopping and spread spectrum techniques to meet military requirements.

The arming and firing control circuitry discussed above provides the interface to control remote firing of the integrated telepresent rapid aiming platform ("trap"). The two unique arm switches are for safety and to prevent any accidental firings. Both the arm 1 and arm 2 switches have to be on in sequence before the fire switch can be triggered to prevent any out of sequence operations from activating the weapon trigger. The switches are easily disarmed by mechanically toggling the switches to the off position. Whenever the arm 1 switch is deactivated, controller 70, FIG. 5 signals safety actuator 102 to push the safety of the weapon into the safe position. The safety is also actuated if at any time there is a loss of communications between the operator control unit and the robotic platform and remains safe until the arm 1 switch command is reset. Power switch 201, FIG. 8, when turned off, completely shuts down the operator control unit and causes the robotic platform to be in the safe mode and to hibernate. A separate on-off switch for the trap system allows the operator shut down the trap system off and still control the robotic vehicle platform. In both cases of a power off operation, the system reverses to an un-arm state. The trap system also provides safety features to prevent inadvertent firing which be caused by operator error or outside input such as vibration, shock, or accidental contact with the trap. The trap system utilizes an electro-mechanical safety to prevent the trap from firing the weapon. When the electro-mechanical safety lock is on, the robotic platform cannot fire within the design limitations of the specific weapon. To successfully fire, the encoded arm signals from the two arming switches of operator control unit 40, FIG. 5 must be received successfully in sequence before the firing signal is accepted. Otherwise, firing circuit 62, FIG. 5 does not respond to any firing signal from fire switch 44. Also, fire circuit 62 is disarmed when either of the arm signals from operator control unit 40 are cancelled by the operator.

Power interrupt module 30 provides the means to interrupt battery power to the robot independent of operator control unit 40. Power interrupt module 30 is remotely controlled by user power interrupt module 50 and has an operating range that exceeds that of communication link 60 between operating control unit 40 which controls robot 10. Power interrupt module 30 is also electrically independent of the robot platform. Further, the communication protocol of communication link 62 is independent of the protocol of communication link 60. The user module portion 50 includes communication link 62, a power source, controller 54, and input button 52.

This module is responsible for final activation/deactivation of vehicle module 30 to form a communication link and then to wait for user input via emergency switch 52. When this input is received, a message is sent to the vehicle module 32 to deactivate. User power interrupt module 50 has its own power source and is independent of operator control unit 40. When kill switch 52 is depressed, a shut down message is sent to power interrupt module 30 on board the robot platform. User power interrupt module 50 is configured via controller 54 to only supply power to radio link 62 when emergency switch 52 is not active. Indicators 51*a*-51*c*, FIG. 4 include power indicator 51*a*, radio power indicator 51*b*, and radios linked indicator 51*c*. The vehicle module 30, FIG. 5 includes communication link 62, a power source (not shown), controller 80, and high power switch 35. Module 30 is configured via controller 80 for continually enabling and disabling communication link 62 until user module 50 is present and listening for a deactivation command from user module 50, and activating and deactivating switch 35.

Communication link 60 typically includes two digital bidirectional transceivers utilized for command, control, and status data communication between robot 10 and operator control unit 40 via an RF RS-232 communication system. A Free Wave Technologies I-520X008 board level transceiver may be used. Communication link 60 is typically a frequency hopping, spread spectrum FCC part 15 radio operating between 2.400-2.4835 GhZ and transmitting 500 mW of output power. The system commands and control radios are provided with fixed ID codes for matching the robot to the operator control unit.

Figure 10:
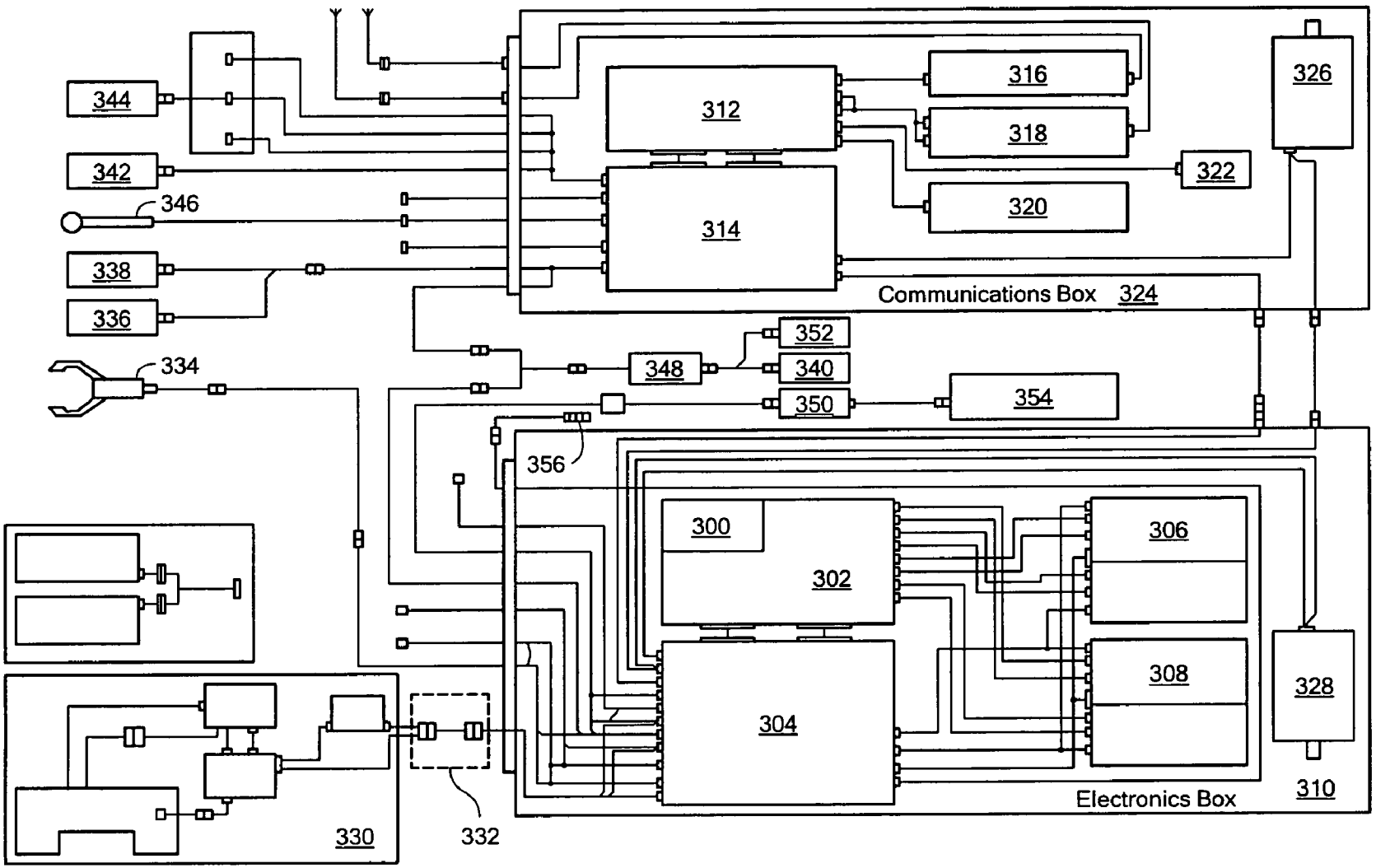
FIG. 10 is a block diagram showing several of the primary components of an example of a robot deployed weapon system in accordance with the subject invention.

FIG. 10 shows one example of a robot vehicle control system in accordance with this invention. When battery 330 is connected to power interrupt module 332, it now has power to its radio every ten seconds for three seconds. The radio listens for radio 56, FIG. 5 and the status of the Stop switch 52. If the module 332, FIG. 10 radio hears the handheld radio and the stop switch is not depressed, the module 332 switches the relay 35, FIG. 5 on and battery power is now supplied to electronics box 310, FIG. 10. Power switch 356 is turned to the on position. The power circuits on power distribution board 304 send the battery power to daughter board 302. The daughter board voltage converters now convert the battery voltage to VCC and +12 volts and send that power to CPU 300 and via power distribution board 302 and to communications box 324 and then on through communication distribution board 314 and to video matrix board 312 which converts the power to isolated VCC and +12 volts. The isolated power is also controlled (switched on and off) via board 312 and is distributed to external cameras 336, 338, 342, and 344 via communications distribution board 314. Power distribution board 304 also turns on power to AMC boards 308 and 306.

Assuming that the OCU is now turned on and radio 316 is connected to the OCU radio, a data string is transferred between the two radios. The data string goes through telemetry radio 316 and into video radio 312. The data string then is sent to CPU 300 via communications distribution board 314, power distribution board 304, and daughter board 302. The string is interpreted and CPU 300 performs the instructed operations. This could mean sending a drive command to AMC 306 and AMC 308, which would in turn, sent drive signals and voltage to right and left drive motors 326 and 328 and the vehicle would drive.

The safety actuator subsystem 354 system receives communications via a communications port on CPU 300. The serial string from the port is converted to differential communications protocol by interface box 350. This communication is then sent to subsystem 354 which interprets the encrypted communications and performs the applicable operation. Subsystem 354 then sends an acknowledgement back to CPU 300 to acknowledge that it has received the instruction. This acknowledgement is used by the OCU to visually tell the operator that the command has been received and the instruction has been completed.

Video for the system is switched on and off from the OCU and the communication link 316 transmits to video board 312 and on to CPU 300. CPU 300 interprets the incoming string and tells board 312 what camera 336, 338, 342, and 344 or illuminator 352 power to switch to on and it also tells video processor 320 what video signal to send to video radio 318. The video transmission is sent back to the OCU with an audio carrier from microphone 346 which signal which goes to video radio 318 via communications distribution board 314. The compass sends compass data to the OCU via the communications link via video board 312 and radio 316.

Safety actuator 334 (see FIGS. 6-7) is controlled by CPU 300 via power distribution board 304 and daughter board 302. Pan/Tilt module 348 is controlled by CPU 300 via board 304 and board 302.

Although specific features of the invention are shown in some drawings and not in others, this is for convenience only as each feature may be combined with any or all of the other features in accordance with the invention. For example, the system and method of this invention is useful in connection with other types of weapons and other subsystems mounted on robots and also in connection with weapons and other subsystems deployed on platforms other than robots. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A robot deployed weapon system comprising:

a remotely controlled mobile robot including:

a weapon mounted to the robot, a firing circuit for the weapon, and a weapon interrupt module;

an operator control unit for remotely operating the robot and the weapon, the operating control unit including a stop switch;

an operator module in communication with the weapon interrupt module, the operator module including a kill switch;

a first communication link between the operator control unit and the robot configured to safe the weapon if the stop switch is activated and/or the first communication link degrades; and a second communication link between the operator module and the weapon interrupt module configured to safe the weapon if the kill switch is activated and/or the second communication link degrades.

2. The system of claim 1 in which the weapon includes a safety and the robot further includes a safety actuator.

3. The system of claim 2 in which the first communication link is configured to activate the safety actuator to engage the safety of the weapon if the stop switch is activated and/or the first communication link degrades.

4. The system of claim 2 in which the second communication link is configured to activate the safety actuator to engage the safety of the weapon if the kill switch is activated and/or the second communication link degrades.

5. The system of claim 1 in which the operator control unit includes an Arm 1 switch, an Arm 2 switch, and a trigger switch which must be activated in order before the firing circuit can fire the weapon.

6. The system of claim 1 in which the range of the second communication link is longer than the range of the first communication link.

7. The system of claim 1 in which the first communication link includes a transceiver on the robot, a controller on the robot, a transceiver in the operator control unit, and a controller in the operator control unit.

8. The system of claim 7 in which the controller of the operator control unit is configured to send a periodic message via the transceiver of the operator control unit to the transceiver on the robot and the controller of the robot is configured to safe the weapon if the periodic message is not received.

9. The system of claim 1 in which the second communication link includes a transceiver in the weapon interrupt module, a controller in the weapon interrupt module, a transceiver in the operator module, and a controller in the operator module.

10. The system of claim 9 in which the controller of the operator unit is configured to send a periodic message via the transceiver of the operator unit to the transceiver of the weapon interrupt module and the controller of the weapon interrupt module is configured to safe the weapon if the periodic message is not received.

11. A robot deployed weapon system comprising:

a robot including:

a weapon mounted to the robot, a firing circuit for the weapon, and a weapon interrupt module;

an operator control unit for remotely operating the robot and the weapon;

an operator module in communication with the weapon interrupt module;

a first communication link between the operator control unit and the robot configured to safe the weapon if the first communication link degrades; and a second communication link between the operator module and the weapon interrupt module configured to safe the weapon if the second communication link degrades.

12. A deployed weapon system comprising:

a platform including:

a weapon mounted to the platform, a firing circuit for the weapon, a weapon safety actuator, and a weapon interrupt module;

an operator control subsystem for remotely operating the platform and the weapon, the operating control subsystem including a stop switch and a kill switch;

a first communication link between the operator control subsystem and the platform configured to actuate the weapon safety actuator and safe the weapon if the stop switch is activated; and a second communication link between the operator control subsystem and the platform configured to activate the weapon interrupt module to safe the weapon if the kill switch is activated.

* * * * *